US008708604B2

(12) United States Patent
Luo et al.

(10) Patent No.: US 8,708,604 B2
(45) Date of Patent: Apr. 29, 2014

(54) QUICK RELEASE SYSTEM FOR TOPSIDES FLOAT-OVER INSTALLATION ON OFFSHORE PLATFORMS

(75) Inventors: Michael Y. H. Luo, Bellaire, TX (US); David N. Edelson, Wallis, TX (US); Steven Barras, Katy, TX (US); Kostas F. Lambrakos, Houston, TX (US); Anil K. Sablok, Houston, TX (US)

(73) Assignee: Technip France, Courbevoie (FR)

( * ) Notice: Subject to any disclaimer, the term of this patent is extended or adjusted under 35 U.S.C. 154(b) by 127 days.

(21) Appl. No.: 13/236,892

(22) Filed: Sep. 20, 2011

(65) Prior Publication Data

US 2013/0071207 A1 Mar. 21, 2013

(51) Int. Cl.
*E02B 17/08* (2006.01)
*E02B 17/02* (2006.01)

(52) U.S. Cl.
CPC ..... *E02B 17/021* (2013.01)
USPC ..... 405/196

(58) Field of Classification Search
USPC ..... 405/195.1, 196, 203, 209, 204; 114/264, 265, 258–260
See application file for complete search history.

(56) References Cited

U.S. PATENT DOCUMENTS

| | | | | | |
|---|---|---|---|---|---|
| 2,907,172 | A | * | 10/1959 | Crake | 405/209 |
| 3,754,403 | A | * | 8/1973 | Mott et al. | 405/196 |
| 3,807,336 | A | * | 4/1974 | Briggs | 114/51 |
| 4,106,875 | A | * | 8/1978 | Jewett | 403/2 |
| 4,252,469 | A | * | 2/1981 | Blight et al. | 405/204 |
| 4,666,340 | A | * | 5/1987 | Cox | 405/204 |
| 4,744,697 | A | * | 5/1988 | Coppens | 405/204 |
| 4,761,097 | A | * | 8/1988 | Turner | 405/204 |
| 4,848,967 | A | * | 7/1989 | Weyler | 405/204 |
| 5,046,896 | A | * | 9/1991 | Cole | 405/195.1 |
| 5,219,451 | A | * | 6/1993 | Datta et al. | 405/204 |
| 5,607,260 | A | * | 3/1997 | Khachaturian | 405/204 |
| 5,609,441 | A | * | 3/1997 | Khachaturian | 405/204 |
| 5,800,093 | A | * | 9/1998 | Khachaturian | 405/204 |
| H001815 | H | * | 11/1999 | Campbell et al. | |
| 5,975,807 | A | * | 11/1999 | Khachaturian | 405/204 |
| 6,171,028 | B1 | * | 1/2001 | Van Gelder | 405/209 |
| 6,293,734 | B1 | * | 9/2001 | Thomas et al. | 405/209 |

(Continued)

FOREIGN PATENT DOCUMENTS

| | | |
|---|---|---|
| GB | 2 165 188 | 4/1986 |
| WO | 2010/136713 | 12/2010 |

OTHER PUBLICATIONS

Luo, M., et al., "Spar Topside Float-Over Installation—Structural Design and Analyses", presented at Deep Offshore Technology conference, Oct. 2007, Norway, 21 pages.

(Continued)

*Primary Examiner* — Tara M. Pinnock
*Assistant Examiner* — Patrick Lambe
(74) *Attorney, Agent, or Firm* — Locke Lord LLP

(57) ABSTRACT

The present invention provides a system and method that keeps a barge and grillage system on the barge in compression with a topsides supported by the grillage system during the transport, while providing a quick release system between the barge, grillage system, and topsides during an installation procedure that transfers the topsides to an offshore platform. The quick release system can be in tension to apply a compressive force between the grillage system and the topsides until the quick release system is released.

22 Claims, 12 Drawing Sheets

(56) References Cited

U.S. PATENT DOCUMENTS

| | | | | |
|---|---|---|---|---|
| 6,318,931 | B1 * | 11/2001 | Khachaturian | 405/204 |
| 6,347,909 | B1 * | 2/2002 | Kocaman | 405/209 |
| 7,513,713 | B2 * | 4/2009 | Thomas et al. | 405/203 |
| 8,061,289 | B2 * | 11/2011 | Khachaturian | 114/51 |
| 8,240,264 | B2 * | 8/2012 | Khachaturian | 114/51 |
| 8,240,265 | B1 * | 8/2012 | Khachaturian | 114/51 |
| 8,251,615 | B2 * | 8/2012 | Finn | 405/205 |
| 8,312,828 | B2 * | 11/2012 | Luo | 114/61.1 |
| 8,517,637 | B2 * | 8/2013 | Thomas et al. | 405/209 |
| 2009/0003937 | A1 * | 1/2009 | Finn | 405/205 |
| 2009/0148241 | A1 * | 6/2009 | Ouwehand | 405/195.1 |
| 2010/0316449 | A1 * | 12/2010 | Ayers et al. | 405/205 |

OTHER PUBLICATIONS

"Pyrotechnic fastener", Wikipedia, 2 pages, [retrieved from the Internet on Jul. 27, 2011 using <URL: http://en.wikipedia.org/wiki/Explosive_bolt>].

"Frangible nut", Wikipedia, 1 page, [retrieved from the Internet on Jul. 27, 2011 using <URL: http://en.wikipedia.org/wiki/Frangible_nut>].

Geisenhofer, M., International Search Report for International Patent Application No. PCT/US2012/055030, dated Feb. 1, 2013, European Patent Office.

Geisenhofer, M., Written Opinion for International Patent Application No. PCT/US2012/055030, dated Feb. 1, 2013, European Patent Office.

* cited by examiner

QUICK RELEASE SYSTEM FOR TOPSIDES FLOAT-OVER INSTALLATION ON OFFSHORE PLATFORMS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relate generally to topsides for offshore platforms and related installation methods; and more specifically related installation methods and systems to release quickly the topsides from one or more associated barges temporarily supporting the topsides for the offshore platforms.

2. Description of the Related Art

Offshore platforms provide an infrastructure for drilling, production, or other functions of offshore energy production. The platform includes a lower structure that is at least partially submerged and an upper structure, known as a topsides or deck, above the water level that contains drilling or production equipment, cranes, living quarters, and the like. In shallow water, fixed offshore platforms can be supported by the seabed. In deeper water, floating offshore platforms are typically moored to the seabed due to the difficulty of rigid placement to the sea floor.

One type of a floating offshore platform is a Spar. A Spar is a type of floating oil platform typically used in very deep waters and is among the largest offshore platforms in use. A Spar includes a large cylinder or hull supporting a typical topsides. Due to its size of hundreds of meters in length, the Spar hull is typically floated horizontally to the installation site, and upended in the water, and then the topsides mounted to the hull. The hull does not extend all the way to the seafloor, but instead is moored by a number of mooring lines. Typically, about 90% of the Spar is underwater and is considered a "deep floater." The hull serves to stabilize the platform in the water, and allows movement to absorb the force of potential high waves, storms or hurricanes. Low motions and a protected center well also provide an excellent configuration for deepwater operations.

Deck or topsides installation is typically a challenge for offshore platforms, particularly for deep draft floaters like the Spar, because the Spar must be upended after transportation to the location site. In the past heavy lifting vessels ("HLV"), including but not limited to, derrick barges have been used for topsides installations on the Spar after upending. Traditionally, the topsides of a floating offshore platform requires multi-lifting, for example five to seven lifts, to install the whole topsides due to the lifting capacity of available HLV. Due to multi-lifting, the steel weight per unity area of the topsides can be higher than that of topsides of any platforms (fixed or floating) installed with a single lifting. If the weight of the topsides is reduced, the weight of the Spar hull may also be reduced.

The same or similar principles are applicable to other offshore platforms to which a topsides can be mounted, whether fixed or floating. The challenge is to mount a large, heavy topsides to the rest of the platform in an offshore or near shore location, where the availability and capacity of lifting vessels may be less than optimum.

One or more barges are generally used to transport a topsides to a floating portion of the offshore platform, such as a Spar hull, for installation thereon. Recently catamaran float-over systems have been used to install the topsides onto the Spar hull. A float-over method is a concept for the installation of the topsides as a single integrated deck onto a Spar hull in which the topsides is first transferred onto at least two barges (called "offloading") and transported with the barges to the installation site for the Spar hull. At the installation site, the barges are positioned on both sides of the Spar hull with the Spar hull below the topsides, the elevation is adjusted between the topsides and the Spar hull, and the topsides is installed to the Spar hull. Installation of the topsides to the Spar hull by the float-over method can allow a high proportion of the hook-up and pre-commissioning work to be completed onshore prior to load-out, which can significantly reduce both the duration and cost of the offshore commissioning phase. The float-over installation method allows for the installation of the integrated topsides or production deck on a fixed or floating platform structure without any heavy lift operation.

FIG. 1 is an exemplary top schematic view of a topsides loaded on two barges in a catamaran system. In general, a catamaran system 100 includes at least a pair of barges 115*a*, 115*b* (generally 115) spaced a distance from each other. A fabricated topsides 110 is removably coupled to the barges 115 through a supporting structure, referenced herein as a grillage system 125*a*, 125*b* (generally 125) mounted to the barges 115*a*, 115*b*, respectively. The grillage system has attachment points 135 for the topsides on each barge. The number of attachment points can vary depending on the load and size of the topsides and the barges. In general, at least two attachment points are used for each barge, although the number can vary from one to many. In the illustration, barge 115*a* with grillage system 125*a* has at least two attachment points 135*a*', 135*a*" and barge 115*b* with grillage system 125*b* has at least two attachment points, 135*b*', 135*b*".

Different loads occur on the catamaran system 100 that are not prevalent in a single barge system due to the separation of the barges. During loading and transportation to the desired location, the catamaran system is subjected to several loading conditions primarily due to wave action on the separated barges.

The topsides is typically maintained on the grillage system by gravity. While some operations connect a fork with a locking plate around a guide pin to restrict lateral movement between the topsides and the barges, the vertical movement is not constrained because the fork and locking plate are not welded to the guide pin.

Some efforts have restrained the topsides vertically with additional members welded to other portions of the grillage system besides the guide pin. However, these weldments are removed prior to the complete transfer of the topsides to the hull, and necessarily allow the undesirable vertical movement. Thus, during the transfer, the topsides, partially supported by the hull, can impact the grillage system on the barges by the differential motion between the floating barges and the Spar hull. The impacts can cause system wide shock waves throughout the structures from repetitive impacts on each other, accompanying structural damage, and possible sensitive equipment failure. It is difficult for personnel to cut welds at each weldment in a timely manner to release the restrained topsides from the barges while wave action is causing significant differential movement between the barges and the Spar hull.

Therefore, there remains a need to provide a system with a topsides that can be restrained vertically but released timely upon becoming supported with an offshore platform during an installation procedure.

BRIEF SUMMARY OF THE INVENTION

The present invention provides a system and method that keeps a barge and grillage system on the barge in compression with a topsides supported by the grillage system during the transport, while providing a quick release system between the barge, grillage system, and topsides during an installation procedure that transfers the topsides to an offshore platform. The quick release system can be in tension to apply a compressive force between the grillage system and the topsides until the quick release system is released.

The disclosure provides a method of loading a topsides onto an offshore platform, comprising: positioning a topsides having a weight in proximity to one or more barges having a grillage system and the grillage system having at least one attachment point for the topsides; transferring at least a portion of the weight of the topsides to the one or more barges; laterally coupling the topsides to the at least one attachment point on the grillage system on the one or more barges; vertically coupling the topsides to the grillage system with at least one quick release system; transporting the topsides and the one or more barges to the offshore platform; adjusting a relative elevation between the topsides and the offshore platform; transferring at least a portion of the weight of the topsides to the offshore platform; laterally uncoupling the topsides from the at least one attachment point on the grillage system on each barge; and vertically uncoupling the topsides from the grillage system by actuating the at least one quick release system.

The disclosure also provides a system for loading a topsides onto an offshore platform, comprising: a topsides having a weight supported on one or more barges having a grillage system and each grillage system having at least one attachment point for the topsides; a means for laterally coupling the topsides to the at least one attachment point on the grillage system on each barge; a means for vertically coupling the topsides to the grillage system with at least one quick release system; a means for laterally uncoupling the topsides from the at least one attachment point on the grillage system on each barge; and a means for vertically uncoupling the topsides from the grillage system by actuating the at least one quick release system.

DETAILED DESCRIPTION

Figure 1:
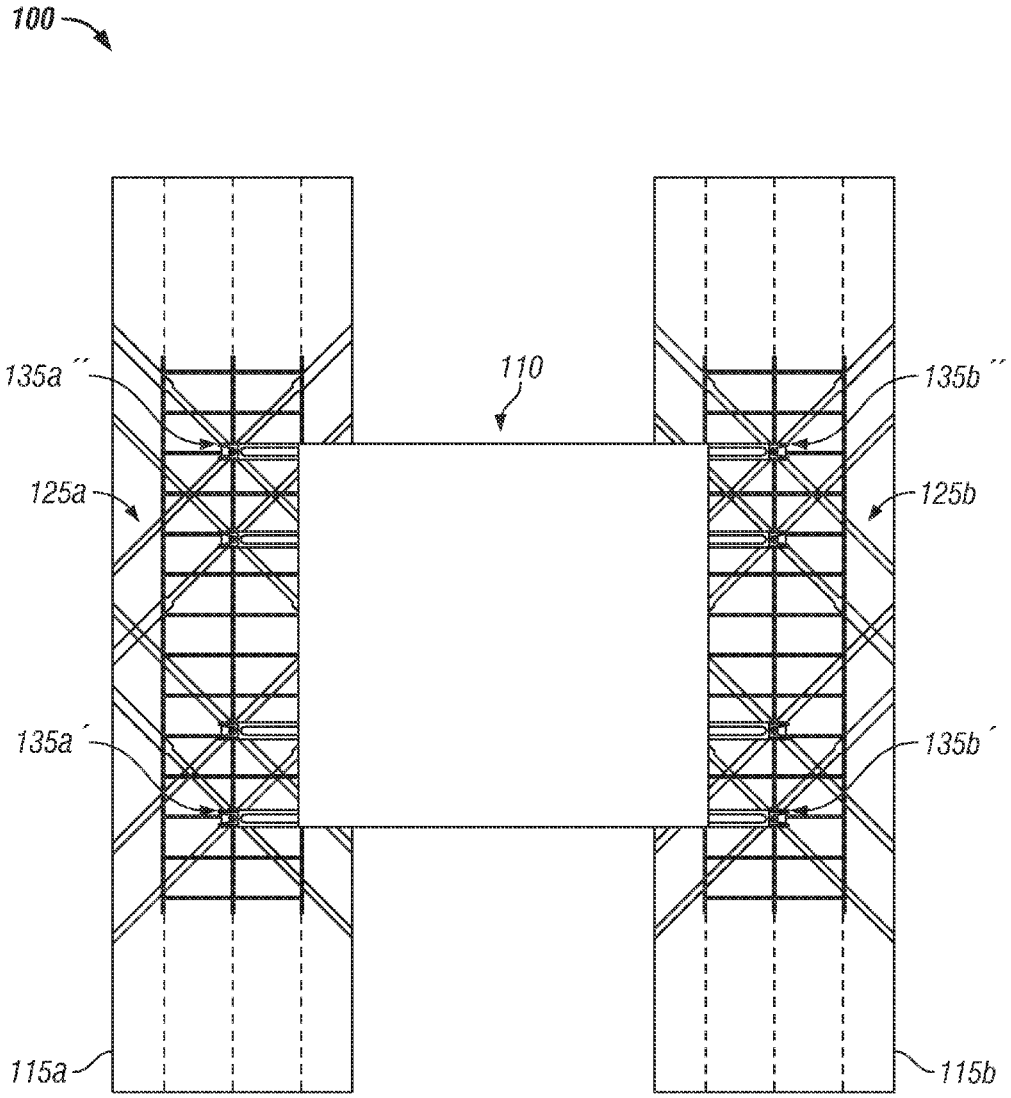
FIG. 1 (Prior Art)
FIG. 1 is a top schematic view of a known topsides loaded on two barges in a catamaran system.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with an "a" or "b" to designate one side of the system or another. When referring generally to such elements, the number without the letter is used. Further, such designations do not limit the number of elements that can be used for that function.

The present invention provides a system and method that keeps a barge and grillage system on the barge in compression with a topsides supported by the grillage system during the transport, while providing a quick release system between the barge, grillage system, and topsides during an installation procedure that transfers the topsides to an offshore platform. The quick release system can be in tension to apply a compressive force between the grillage system and the topsides until the quick release system is released.

The installation of the topsides onto an offshore platform, such as a Spar hull, can involve several major steps. The Figures illustrate various steps of an exemplary procedure to achieve preloading on a catamaran system that can be used to install one or more topsides on an offshore platform. Each figure will be described below in the context of a Spar hull with the understanding that the same or similar procedure can be used with other offshore platforms, including those with variable elevations as floating offshore platforms, and those with a fixed elevation where the barges can provide variable elevations relative to the platforms. Further, it is expressly contemplated that the quick release system can be used with one barge sufficiently large to transfer the topsides to the offshore platform, and thus, the float-over procedure described herein is only exemplary in explaining the underlying aspects of the invention. The term "barge" herein is used broadly to include a barge suitable to be used for a float-over procedure described herein, a single barge configured to transport a topsides to the offshore platform for installation thereon, and other types of transportation vessels suitable to transport the topsides.

An initial step is to load the topsides from the fabrication yard onto the deck of a transportation barge and then tow the transportation barge from the fabrication yard to a sheltered location, including, but not limited to, a quayside location. A quayside location is a structure built parallel to the bank of a waterway for use as a landing place. A next step is to transfer the topsides from the transportation barge to at least one barge, and generally at least two barges, at the sheltered quayside to create a catamaran system that will be used to install the topsides on a Spar hull.

Figure 2A:
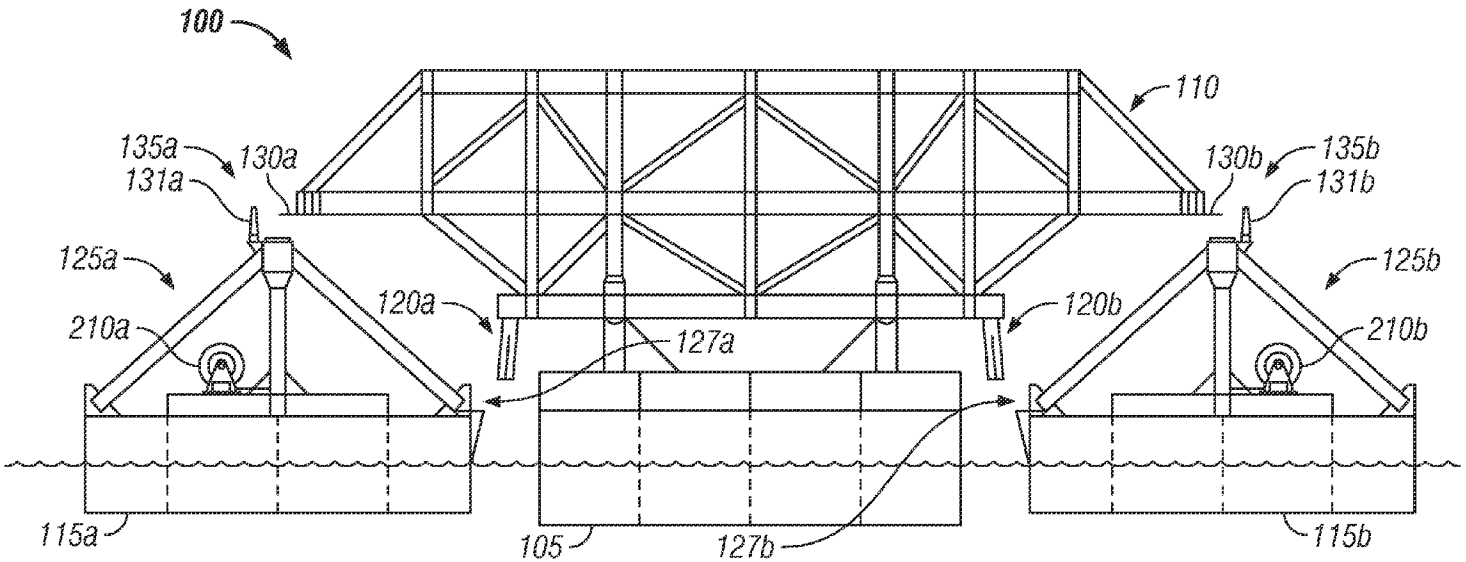
FIG. 2A is a schematic end view of an exemplary embodiment of a topsides being offloaded from a single transportation barge to two barges, according to the invention.
Figure 2B:
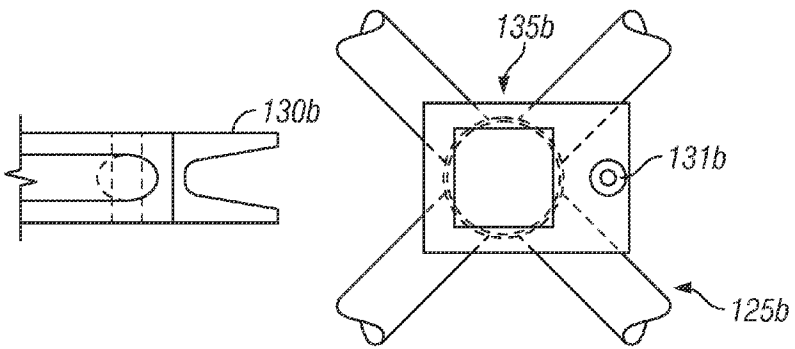
FIG. 2B is a schematic top view of a detail portion of the topsides from FIG. 2A to be coupled with a portion of the grillage system.

FIG. 2A is a schematic end view of an exemplary embodiment of a topsides being offloaded from a single transportation barge to two barges. FIG. 2B is a schematic top view of a detail portion of the topsides from FIG. 2A to be coupled with a portion of the grillage system. The figures will be described in conjunction with each other.

A single transportation barge 105 can be loaded with the topsides 110 from a fabrication facility and towed into proximity to one or more barges 115*a* and 115*b* (generally 115) for offloading thereon. The barges 115 spaced a distance from each other together with the topsides loaded thereon creates a catamaran system 100 for towing or otherwise transporting the topsides to the Spar hull (not shown) for an exemplary float-over procedure described herein. The barges 115 are designed to provide buoyancy for the load of the topsides 110 and withstand environmental load of sea and weather conditions during the catamaran towing of the topsides to the Spar hull.

Each of the two barges 115 has a grillage system, 125*a* and 125*b* (generally 125). The grillage system 125 generally has an array of beams and crossbeams (or just a beam; not illustrated) with attachment points for the topsides, such as described below.

The topsides 110 is provided with a fork 130*a*, 130*b* (generally 130) on the topsides. The attachment points 135 of the grillage system 125 is provided with a tall installation guide pin 131*a*, 131*b* (generally 131). The forks 130 on the topsides are designed to guide the barge's grillage systems 125 to a coupling position with the topsides using the installation guide pins 131. An actuator 210*a* can be coupled to the barge 115*a*, such as coupled to the grillage system 125*a* on such a barge, and an actuator 210*b* can be coupled to the barge 115*b*. An embodiment of the actuators 210*a*, 210*b* (collectively, "210") and their relation to the quick release system is described in more detail below in reference to FIGS. 5A-7, with another embodiment described in reference to FIGS. 8A-8D, and another embodiment described in reference to FIGS. 9A-9D.

Another step is installing sea fastening members to secure the grillage systems mounted to the barges with the topsides.

Figure 3A:
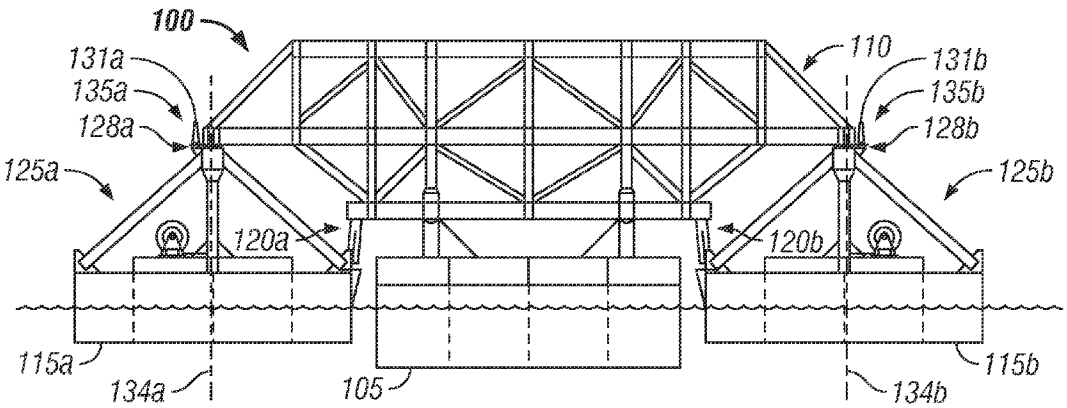
FIG. 3A is a schematic end view of an exemplary embodiment of a topsides coupled to the grillage system of the barges.
Figure 3D:
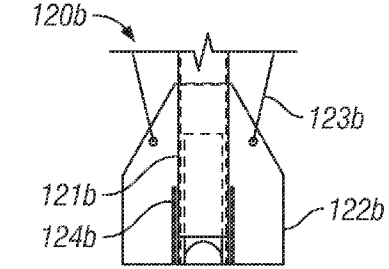
FIG. 3D is a schematic side view of the bracing member of FIG. 3C.

FIG. 3A is a schematic end view of an exemplary embodiment of a topsides coupled to the grillage system of the barges. FIG. 3B is a schematic top view of a detail portion of the topsides and the grillage system from FIG. 3A with sea fastening coupled between an attachment point of the grillage system and the topsides. The figures will be described in conjunction with each other.

The grillage system 125 can provide a number of hingeable couplings to connect with the topsides. The nature of the fastening can create a solid hinge system that is bendable in response to loading on the topsides relative to the barges. The term "hingeable" coupling is used broadly and is not limited to a pair of plates rotating about an enclosed pin. For example, a hingeable coupling can include a bendable coupling that can flex and bend as needed or one that is constrained significantly in one plane and flexibly located in another plane. Examples are described herein. Also, it should be appreciated that a person of ordinary skill could design the grillage system with any number or type of supports and in any configuration to accomplish the goal of creating a catamaran system 100. As one example, when the fork 130 of the topsides is engaged with the guide pin 131 on a barge, a locking plate 132*b* (generally 132) with an opening suitable for a guide pin can be placed on the side of the guide pin 131 opposite the fork 130 and welded or otherwise coupled to the fork to entrap the guide pin therebetween to restrict lateral movement. Alternatively, the locking plate 132 can have an opening, such as a hole, that is sized to surround the guide pin 131, and be placed over the guide pin and coupled to the fork 130 to restrict lateral movement.

This coupling of the fork 130 with the locking plate 132 restricts the horizontal movement between the topsides and the barge, but still allows vertical or bending movement, because the fork and the locking plate are not welded to the guide pin. Further, the fork can be made of plate steel, such as and without limitation 1 inch (25 mm) thick plate, that relative to the mass of the topsides forms a bendable solid hinge 128*a*, 128*b* (generally 128), and can flex as needed for bending movement between the topsides and the barges.

In general, the topsides fork 130 and guide pin 131 will be coupled near a lateral center of gravity 134*a*, 134*b* (generally 134) of the barges 115*a*, 115*b*, respectively. The lateral center of gravity will be generally the center of the barges from side to side when the barges are constructed symmetrically from side to side. The coupling can occur along the length of the barge at one or more longitudinal attachment points. When multiple lateral attachment points are used to couple the topsides to the barge through the grillage, the coupling can be made effectively at the lateral center of gravity, for example, where two lateral attachment points might be equidistant from the lateral center of the barges, so that the result is an effective coupling through the center of gravity, as might be present in a single barge configuration.

Further, after the topsides' weight is transferred to the barges 115, the middle barge 105 can be pulled out. In general, the barge 105 can be removed after the topsides is secured at least laterally to the barges 115, such as with the locking plate 132.

In at least one embodiment, the topsides 110 can be supported by at least two and advantageously four attachment points 135 of the grillage system 125 with the forks/locking plates and guide pins along the length of the barges 115. However, a person of ordinary skill could design any number of supporting locations and mechanisms for the topsides 110 on the barges 115.

Figure 3C:
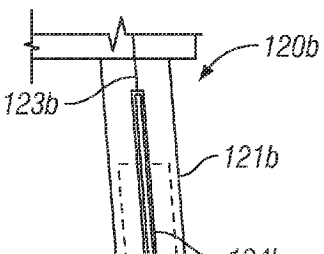
FIG. 3C is a schematic end view of a detail portion of a bracing member on the topsides from FIG. 3A disposed above a portion of the grillage system adjacent the barge.
Figure 3B:
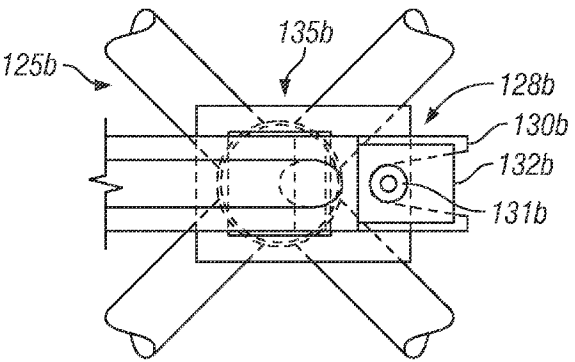
FIG. 3B is a schematic top view of a detail portion of the topsides and the grillage system from FIG. 3A with sea fastening coupled between an attachment point of the grillage system and the topsides.
Figure 3D:
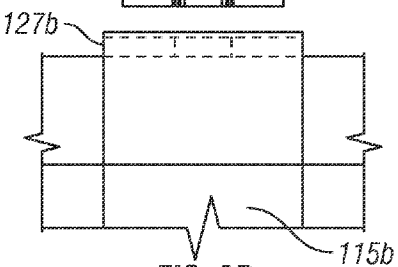
Figure 3C:
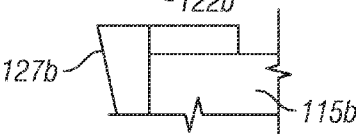

FIG. 3C is a schematic end view of a detail portion of a bracing member on the topsides from FIG. 3A disposed above a portion of the grillage system adjacent to the barge. FIG. 3D is a schematic side view of the bracing member of FIG. 3C. The figures will be described in conjunction with each other.

Another hingeable coupling at a hinge between the topsides and barges can be made by coupling a tie down bracing member 120*a*, 120*b* (generally 120 and also shown in FIG. 2A) between the topsides 110 and the grillage system 125 on each barge. The bracing member 120 can include a center tubular member 121*b* (generally 121) and an extendable plate 122*b* (generally 122). The tubular member 121 can include a slot 124*b* (generally 124), shown particularly in FIG. 3C, through which the plate 122 is slidably coupled. One or more fasteners 123*b* (generally 123) such as wire rope or chain, can secure the plate 122 in a retracted position in the tubular member 121. In at least one embodiment, the tie down bracing members 120 are not welded to the barges until substantially all the weight of the topsides is transferred from the transportation barge 105 to the barges 115.

The tie down bracing member 120 in a retracted position can be positioned above a tie down structure 127*a*, 127*b* (generally 127) of the barges 115, adjacent the barge inner edge shown in FIGS. 3C-3D. The bracing member 120 is generally disposed laterally inward from the center of gravity 134 of the barges and toward a center of the topsides. In at least one embodiment, the bracing members 120 on the between the topsides and the barges (such as the grillage systems coupled to the barges) reduces the length of an unsupported portion of the topsides between the guide pins 131.

Figure 4A:
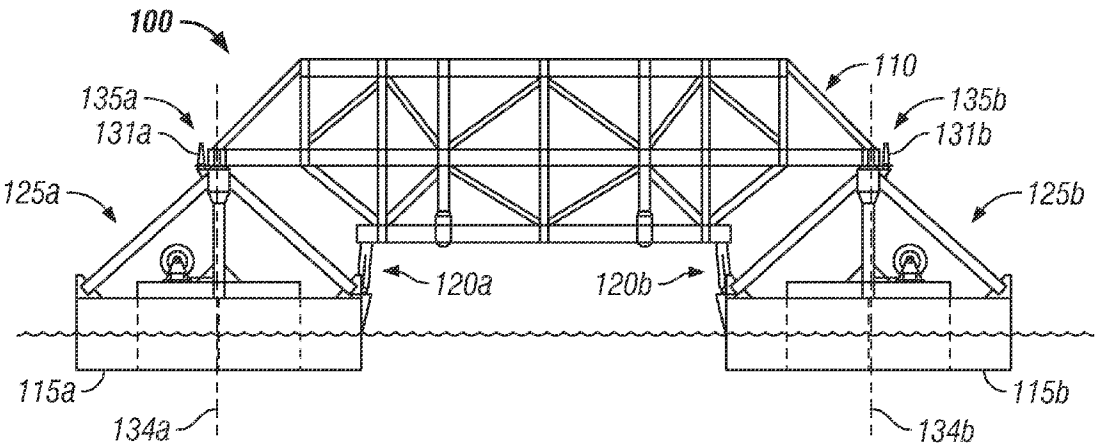
FIG. 4A is a schematic end view of an exemplary embodiment of a topsides coupled to the grillage system of the barges with all the sea fastenings installed.
Figure 4B:
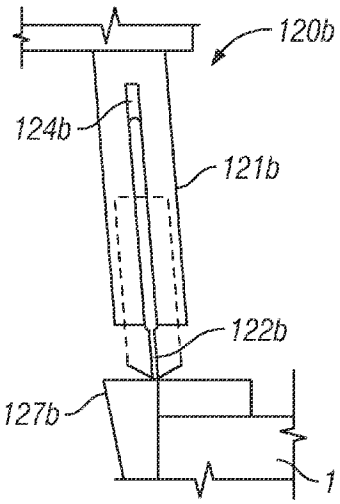
FIG. 4B is a schematic end view of a detail portion of the topsides from FIG. 4A coupled with the barge using the sea fastenings.
Figure 4C:
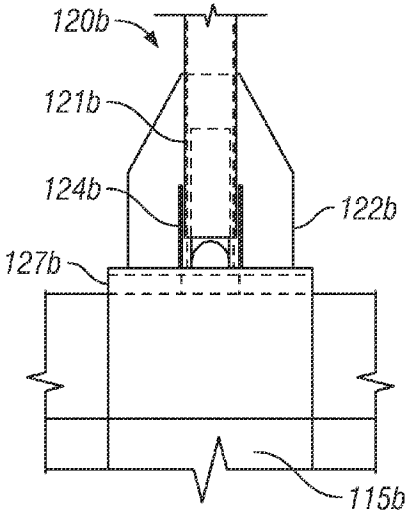
FIG. 4C is a schematic side view of a detail portion of the bracing member coupled between the topsides and the barge from FIG. 4B.

FIG. 4A is a schematic end view of an exemplary embodiment of a topsides coupled to the grillage system of the barges with all the sea fastenings installed. FIG. 4B is a schematic end view of a detail portion of the topsides from FIG. 4A coupled with the barge using the sea fastenings. FIG. 4C is a schematic side view of a detail portion of the bracing member coupled between the topsides and the barge from FIG. 4B.

After the load of the topsides 110 is transferred from the transportation barge to the barges 115, the bracing member 120, specifically the plate 122, can be dropped down and welded to the tie down structure 127, as shown in FIGS. 4B-4C. Further, the plate 122 can be welded to the tubular member 121, so that the coupling between the topsides and the grillage system is fixed in length. The plate 122 can be made of two, thin side plates welded to the support structure and one thicker middle plate with stiffeners coupled to the support structure, that relative to the size of the topsides forms a bendable solid hinge that can flex as needed for bending movement of the topsides relative to the barges. Thus at this time, the topsides 110 is secured with the grillage system 125 laterally around the guide pins 131 and vertically with the bracing members 120.

The grillage system 125 of supports and bracing members make the topsides-barge system similar to a rigid catamaran with hinged links at sea fastening members, such as the fork 130/locking plate 132 and bracing member 120, thus creating the catamaran system 100.

Figure 5A:
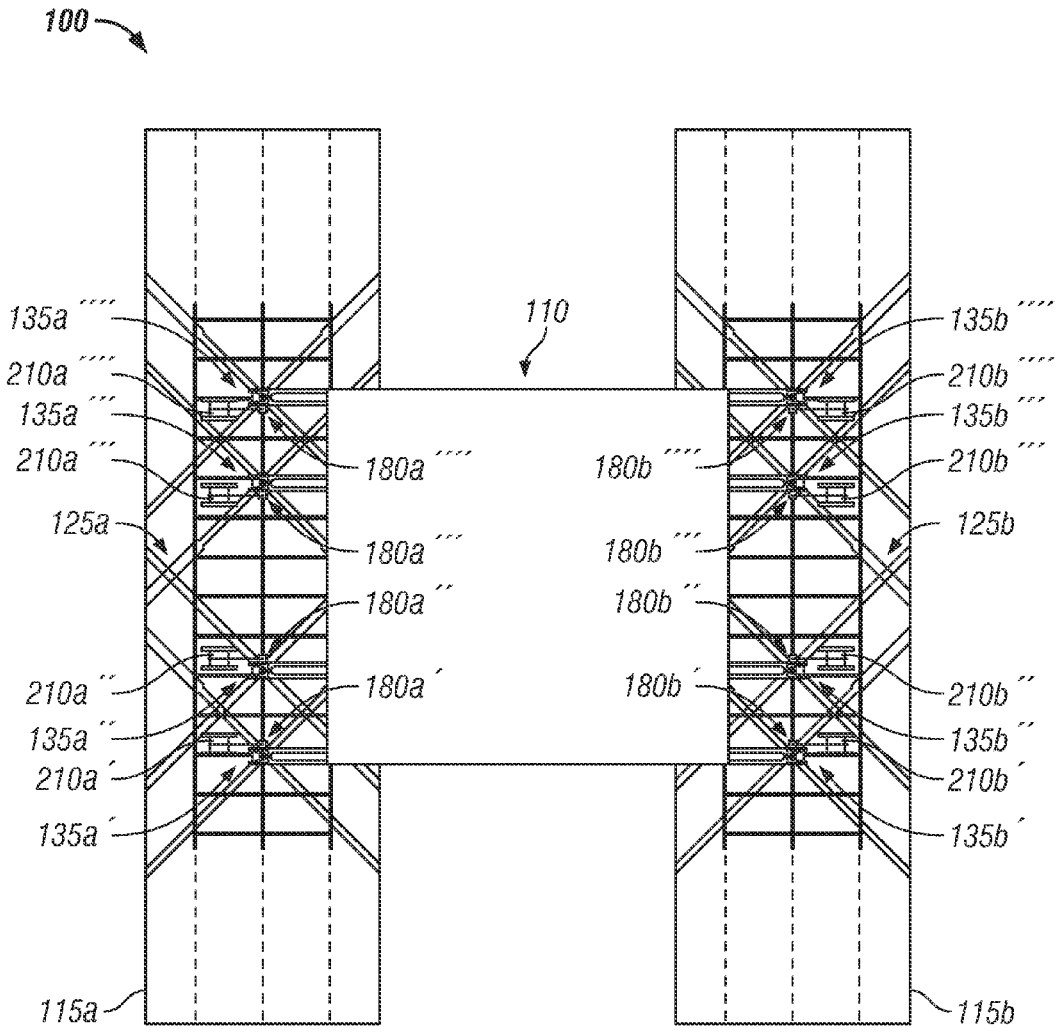
FIG. 5A is a top schematic view of a topsides loaded on two barges according to the invention with at least one quick release system.

FIG. 5A is a top schematic view of a topsides loaded on two barges according to the invention with at least one quick release system. Another step is coupling a quick release system 180 between the topsides 110 and the grillage system 125 that is coupled to the barges 115. Thus, the topsides is restrained vertically through the grillage system ultimately to the barges with the at least one quick release system. The number of quick release systems 180 can vary depending on the number of attachment points. In general, it is contemplated that at least two quick release systems will be installed on at least two respective attachment points 135 on each barge 115.

FIG. 5A shows two barges 115*a*, 115*b* with the topsides 110 loaded thereon with four attachment points on each barge, although the number can vary. In at least one embodiment, at least some of the attachment points on each barge can include at least one quick release system 180 and can include at least one actuator 210. For example, the barge 115*a* can include the attachment points 135*a*', 135*a*", 135*a*"', 135*a*"" (generally 135) having quick release systems 180*a*', 180*a*", 180*a*"', 180*a*"" (generally 180) with actuators 210*a*', 210*a*", 210*a*"', 210*a*"" (generally 210) for the respective quick release systems at the respective attachment points. Similarly, the barge 115*b* can include the attachment points 135*b*', 135*b*", 135*b*"', 135*b*"" having quick release systems 180*b*', 180*b*", 180*b*"', 180*b*"" with actuators 210*b*', 210*b*", 210*b*"', 210*b*"" for the respective quick release systems at the respective attachment points. In at least one embodiment, the actuators can be operatively coupled to synchronize their release of their respective quick release systems. The operative coupling can occur electrically, such as through wiring or wirelessly, or mechanically, such as through linkages, hydraulically, pneumatically, and other means of coupling the operation with one or more other actuators.

Figure 5B:
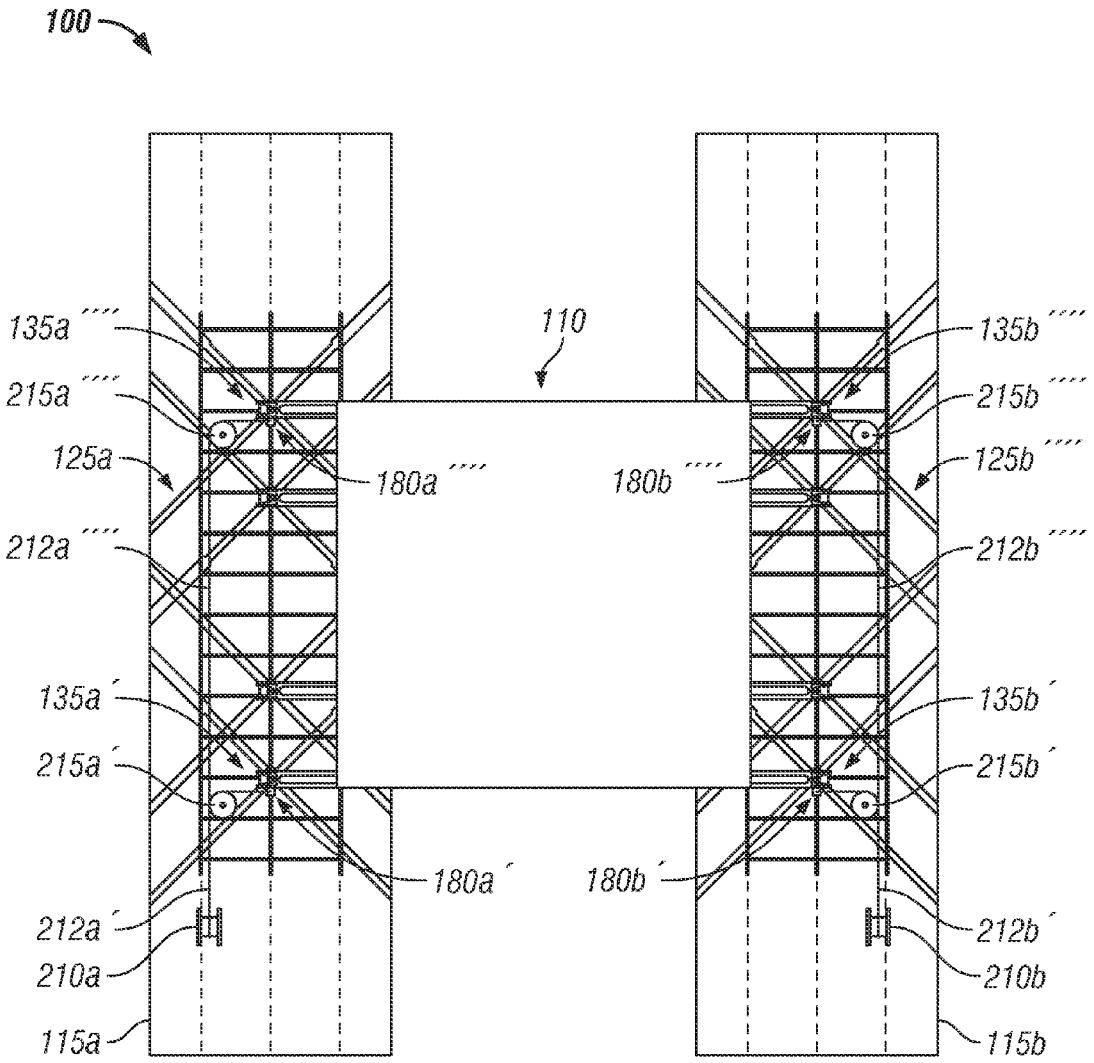
FIG. 5B is a top schematic view of a topsides loaded on two barges according to the invention with at least one alternative quick release system.

FIG. 5B is a top schematic view of a topsides loaded on two barges according to the invention with at least one alternative quick release system. The embodiment in FIG. 5B shows an actuator controlling the release of multiple quick release systems. (For variation and ease of reference, only two attachment points are labeled, with the understanding that the number of actual attachment points can vary.) For example, an actuator 210*a* can control the release of the quick release system 180*a*' at the attachment point 135*a*' and the quick release system 180*a*"" at the attachment point 135*a*"". Similarly, an actuator 210*b* can control the release of the quick release system 180*b*' at the attachment point 135*b*' and the quick release system 180*b*"" at the attachment point 135*b*"".

In at least one embodiment, the actuators 210 can control the respective releases by means of flexible links coupled to the respective quick release systems. The term "flexible link" is used broadly and includes cables, wire, rope, slings, chains, rods, and other linkages that can be pulled or pushed to cause a motion, and includes associated hardware such as clamps, fasteners, links, couplers, and the like. One or more pulleys can be used to guide a flexible link around turns. For example on barge 115*a*, the actuator 210*a* can be coupled to a flexible link 212*a*' around a pulley 215*a*' to be coupled to the quick release system 180*a*' at the attachment point 135*a*' of the grillage 125*a*. The same actuator 210*a* can also be coupled to a flexible link 212*a*"" around a pulley 215*a*"" to be coupled to the quick release system 180*a*"" at the attachment point 135*a*"" of the grillage 125*a*. Thus, the actuator 210*a* can actuate both quick release systems 180*a*' and 180*a*"". The actuation can occur in a synchronized matter, such as substantially simultaneously, so that the topsides is released evenly from the barge 115*a*. A similar system can be used for the barge 115*b* with similar elements similarly labeled.

Figure 5D:
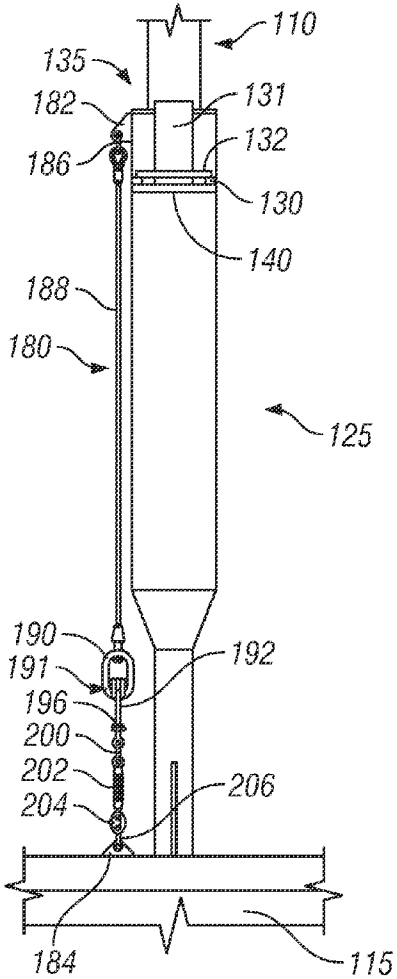
FIG. 5D is a schematic side view of a quick release system of FIG. 5C.
Figure 5C:
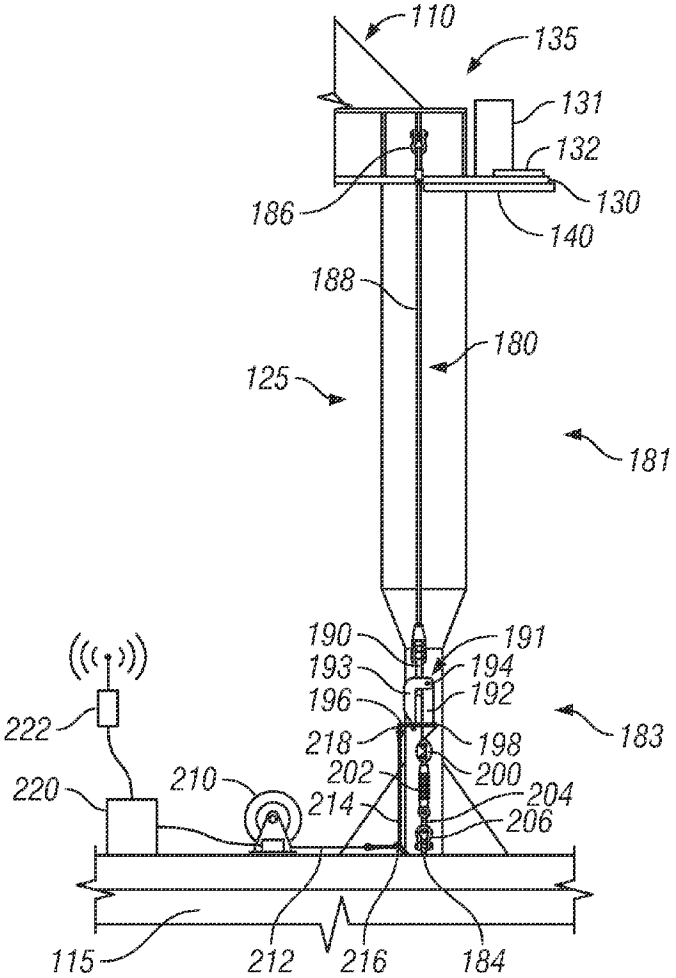
FIG. 5C is a schematic end view of a quick release system coupled between the topsides and the grillage system.
Figure 5E:
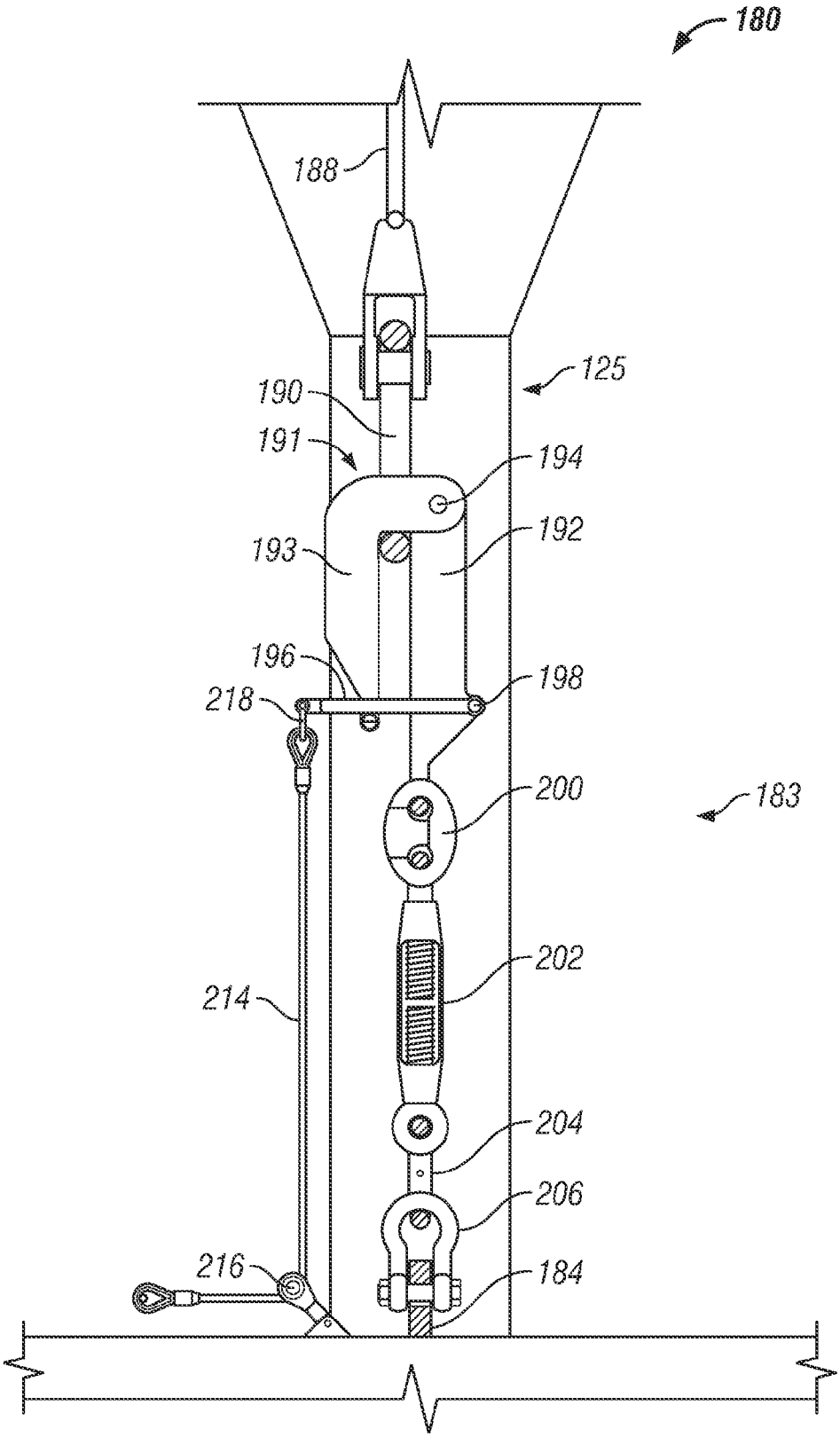
FIG. 5E is a schematic end view of the quick release system in a closed position, as an enlarged view from FIG. 5C.

FIG. 5C is a schematic end view of a quick release system coupled between the topsides and the grillage system. FIG. 5D is a schematic side view of a quick release system of FIG. 5C. FIG. 5E is a schematic end view of the quick release system in a closed position, as an enlarged view from FIG. 5C. The figures provide more details of the quick release system described in reference to FIGS. 5A-5B, and will be described in conjunction with each other.

In at least one embodiment, the quick release system 180 can be placed in tension to pull the topsides 110 into proximity and preferably into contact with the grillage system 125. In the embodiment shown, for example, the quick release system 180 can pull the topsides 110 into compressive load contact with a grillage support plate 140 of the grillage system 125 to limit further vertical movement of the topsides relative to the grillage system.

In general, a portion 181 of the quick release system can be coupled between one of the topsides 110 or the grillage system 125 to a releasable element 191, such as a releasable hook, as shown in FIGS. 5C-5E. Another portion 183 of the quick release system can be coupled to the other of the topsides or the grillage system. The releasable element 191 can be actuated to release at least one of the portions, so that the topsides can be released from the grillage system. The quick release system on one attachment point can be operatively coupled with one or more other quick release systems on one or more other attachment points whether on one barge or on both barges. When all quick release systems are synchronized, a virtually simultaneous release of the topsides from the grillage system can be accomplished as described in more detail below.

In at least one embodiment, the quick release system 180 can include a series of flexible links with associated connections that are coupled with the releasable element 191. Using the exemplary orientation of components in the relevant Figures, an upper padeye 182 can be coupled to the topsides 110 in a position to allow attachment of the quick release system 180 on one end. A corresponding lower padeye 184 can couple to the grillage system 125 in a position to allow attachment of the quick release system 180 on the other end. Starting at the upper padeye 182, a shackle 186 can be coupled between the padeye 182 and a quick release flexible link 188. The quick release flexible link 188 can extend downward to a master link 190 that can be engaged with a releasable element 191, such as a releasable hook 192. The exemplary releasable hook 192 includes a rotatable portion 193 rotatably coupled through a hinge joint 194 to the remainder of the hook 192. A commercially available example of a releasable hook is known as a "Pelican hook", available from a variety of third party vendors. A latch 196 (also known as a bale) is rotatably coupled to the releasable hook 192, through a hinge joint 198 and helps maintain the rotatable portion 193 in a latched position until ready for release. A connecting link 200 is coupled between the hook 192 (distal from the master link 190) and a tension adjuster 202, such as a turnbuckle. In at least one embodiment, the tension adjuster 202 can adjust the tension on the flexible link 188 and the hook 192 by adjusting an overall length of the quick release system 180. In turn, the tension adjuster 202 can be coupled to a connecting link 204, which can be coupled to a shackle 206, and then to the lower padeye 184, which is coupled to the grillage system 125.

Further, an actuator 210 can be used to release the quick release system 180. In at least one embodiment, the actuator can be a mechanical based actuator, such as a winch 210. The winch 210 includes an actuator flexible link 212 that can be coupled to a flexible link 214, which in turn is coupled to the latch 196 on the hook 192 through shackle 218. Pulleys, such as a snatch block 216, can be used for miscellaneous turns in direction for the flexible link 212 and/or flexible link 214. The actuator, such as a winch, can be actuated electrically, hydraulically, pneumatically, or manually. If by powered actuation, a control system 220 can be used to control the actuation. For timing and possible synchronization with other actuators 210 at other attachment points 135 of the grillage system 125, a communicator 222 can be used. The communicator 222 can be wired or wireless to communicate with other communicators and other control systems that are coupled with other quick release systems at other attachment points.

While the quick release system is described in terms of flexible links, such as wire slings or chains, and mechanical actuation, it is understood that operational variations are contemplated. For example, hydraulic, pneumatic, electrical linear movement or rotational movement can cause the quick release system to release. Further, rods can be used instead of wire slings, and removable bolts, clamps, latches, and the like can be used instead of a releasable hook to accomplish the quick release function of the quick release system.

Figure 6A:
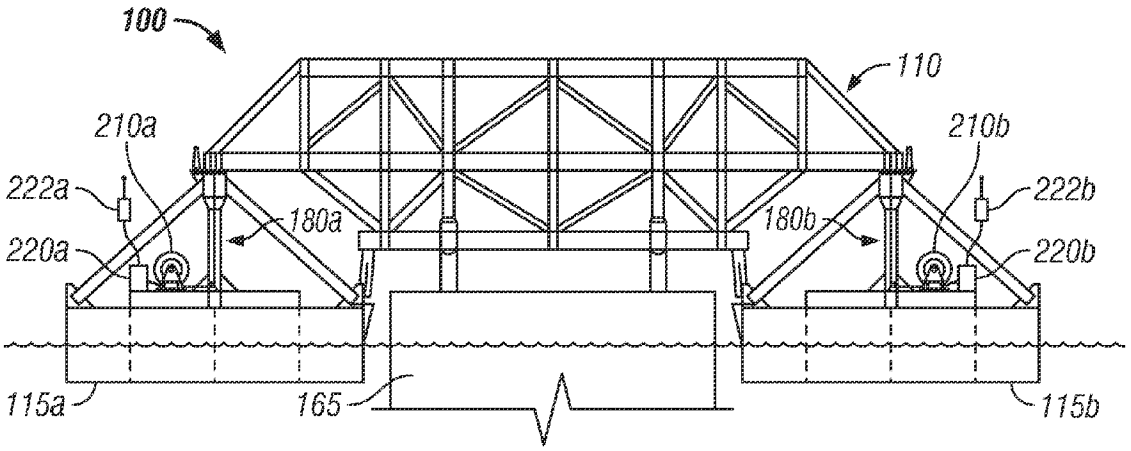
FIG. 6A is a schematic end view of the barges floating over an offshore platform, such as a Spar hull.
Figure 6C:
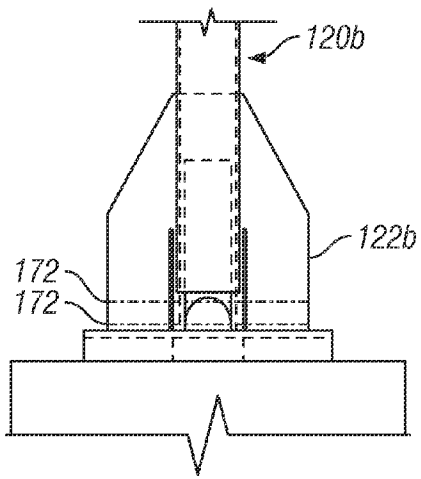
FIG. 6C is a schematic top view of a detail portion of the topsides from FIG. 6A with the sea fastening between barge and pre-installed bracing member of the topsides removed.
Figure 6B:
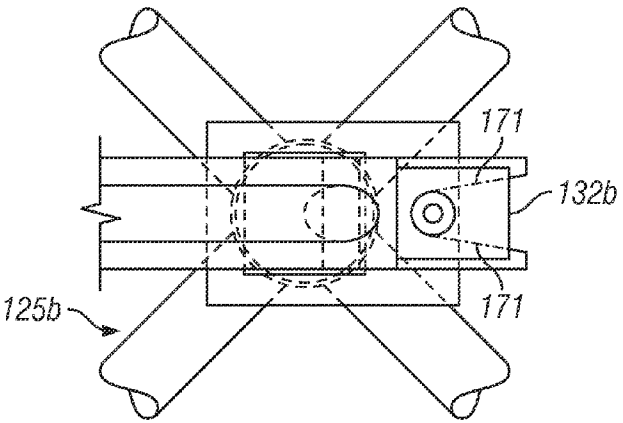
FIG. 6B is a schematic top view of a detail portion of the topsides from FIG. 6A with the sea fastening between grillage top and topsides removed.

FIG. 6A is a schematic end view of the barges floating over an offshore platform, such as a Spar hull. FIG. 6B is a schematic top view of a detail portion of the topsides from FIG. 6A with the sea fastening between grillage top and topsides removed. FIG. 6C is a schematic top view of a detail portion of the topsides from FIG. 6A with the sea fastening between barge and pre-installed bracing member of the topsides removed. The figures will be described in conjunction with each other.

The next step is transferring the topsides to the offshore platform, such as a Spar hull. In general, a floating offshore platform 165 can be at least partially de-ballasted, such that weight of the topsides 110 can be gradually and safely transferred to supports at the top of the offshore platform. If the offshore platform 165 is a fixed offshore platform, then the barges can be ballasted. In either example, the relative elevations between the offshore platform and the barges (and the topsides on the barges) changes, so that the topsides engages and is at least partially supported by the offshore platform. The above procedures can be adapted with the use of a single barge to transfer the topsides to the offshore platform.

Once at least a partial weight of the topsides 110 is transferred from the barges 115 to the offshore platform 165, the bracing members 120 between the topsides 110 and the barges 115 can be cut or the welds can be removed, for example at locations 172, so that the bracing members are uncoupled, as shown in FIG. 6B. Other than gravity forces on any remaining weight on the grillage system 125, the topsides 110 is vertically restrained with the grillage system at this time primarily by the quick release system 180. After uncoupling the bracing members, the topsides 110 is still restrained laterally at the fork/locking plate locations on the barges 115. Before transferring the load from the barges 115 to the hull of the offshore platform 165, the locking plates 132 may be cut, for example at locations 171, and any lashing lines can be detached to ultimately allow the barges to be pulled away from topsides, as shown in FIG. 6B.

Figure 7:
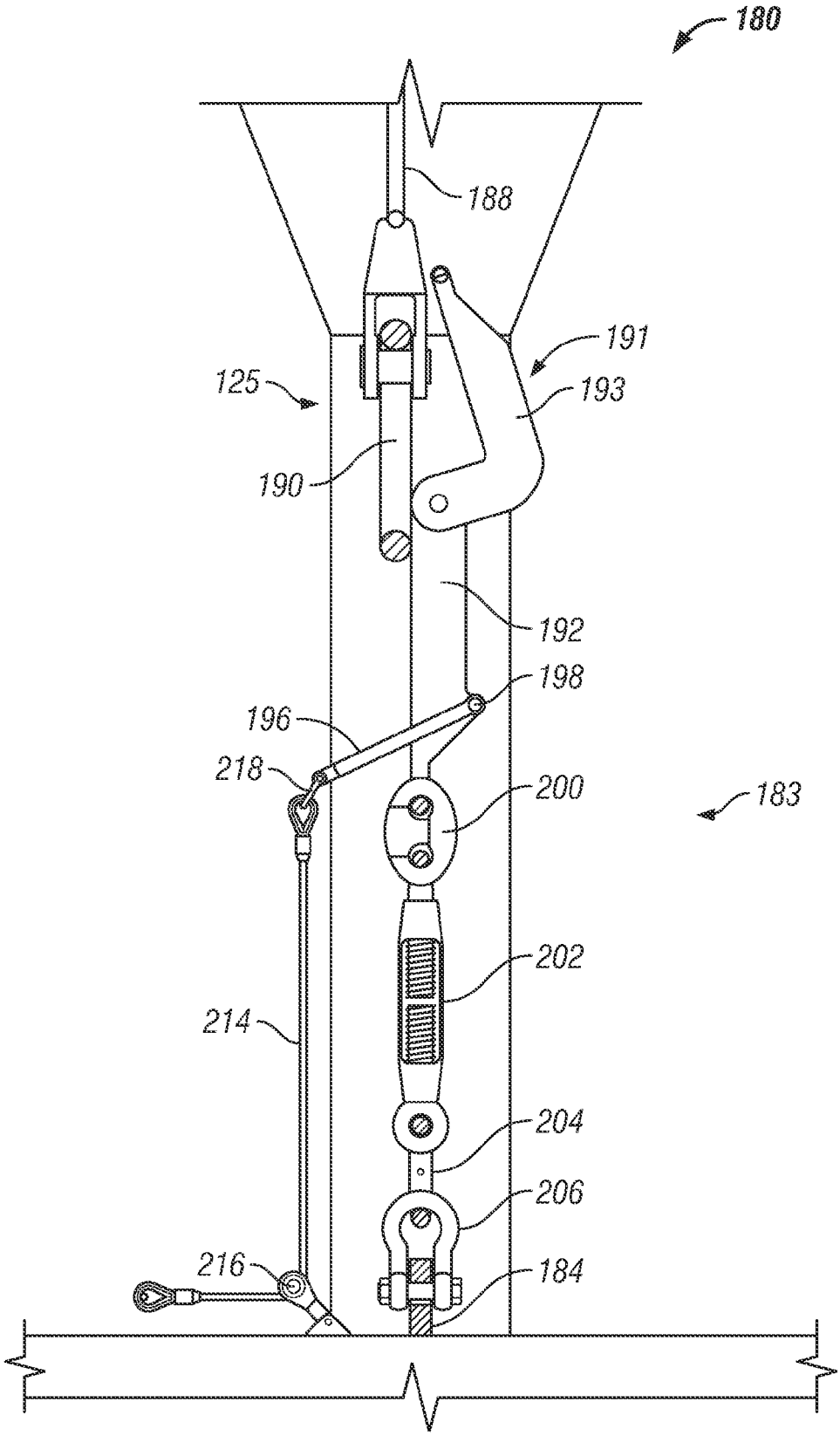
FIG. 7 is a schematic end view of the quick release system in a released position.

FIG. 7 is a schematic end view of the quick release system in a released position. After substantially all of the topsides weight is supported by the offshore platform, the actuator 210 (as shown in FIG. 5C) can pull the latch 196 to release the rotatable portion 193 of the hook 192. The master link 190 and the quick release flexible link 188 are released. If other quick release systems on other attachment points are synchronized, the entire topsides previously connected to the grillage system at multiple attachment points can be released virtually simultaneously.

Once the topsides is released, a floating offshore platform 165 (as shown in FIG. 6A) can raise the topsides to vertically clear the guide pins 131, or the barges 115 can be ballasted to lower the guide pins for clearance for a fixed offshore platform. When the barges 115 are free from the topsides 110, the barges 115 can be pulled away from the offshore platform.

Figure 8C:
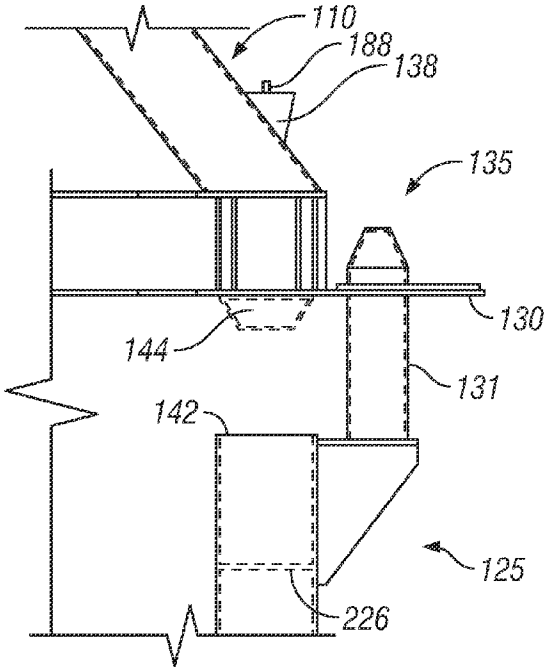
FIG. 8C is a schematic end view of the embodiment of FIG. 8A with the quick release system in a released position.
Figure 8D:
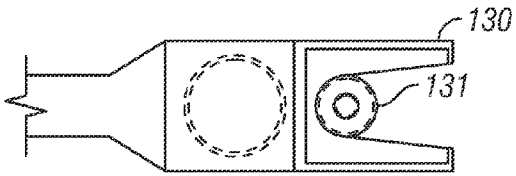
FIG. 8D is a schematic top view of the embodiment of FIG. 8C in the released position.
Figure 8A:
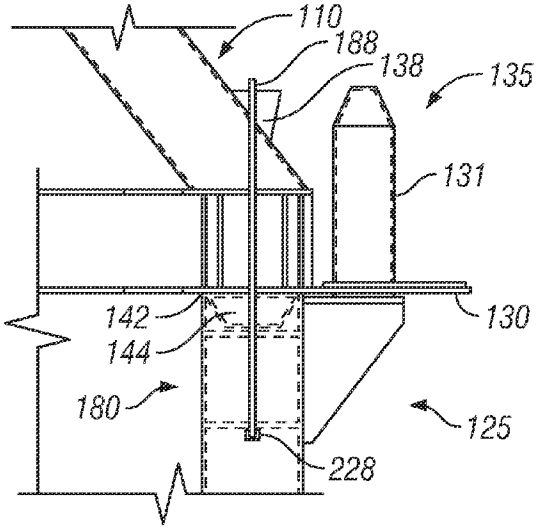
FIG. 8A is a schematic end view of another embodiment of the quick release system in a closed position.
Figure 8B:
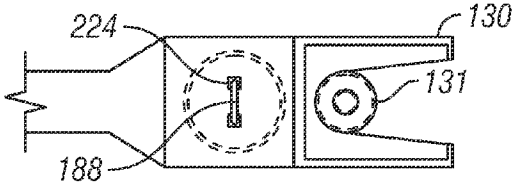
FIG. 8B is a schematic top view of the embodiment of FIG. 8A in the closed position.

FIG. 8A is a schematic end view of another embodiment of the quick release system in a closed position. FIG. 8B is a schematic top view of the embodiment of FIG. 8A in the closed position. FIG. 8C is a schematic end view of the embodiment of FIG. 8A with the quick release system in an open position. FIG. 8D is a schematic top view of the embodiment of FIG. 8C in the open position. The figures will be described in conjunction with each other. The grillage system 125 can include a grillage seat 142, and the topsides 110 can include a seating guide 144 to engage the grillage seat and limit the downward travel of the topsides relative to the grillage system. The grillage seat 142 can also have a lateral anchor plate 226 positioned below the seating guide 144 when engaged with the grillage seat. The quick release system 180 can include at least one flexible link and advantageously at least two flexible links 188 coupled between the topsides 110 and the grillage system 125. The flexible links can have a rated tensile load failure strength after which the flexible link will break. For example, the flexible links can be coupled between a support structure 138 on the topsides 110 and the anchor plate 226 on the grillage system with one or more anchors 228 coupled to the flexible links through openings 224 formed therethrough for the flexible links. The flexible links can be designed to fail at a given rated tensile load.

In operation, the topsides could be transferred to the offshore structure, so that as the offshore structure progressively supports more of the topsides load and displaces the load away from the barges, the tensile force on the flexible links would increase. The increased force eventually would actuate the quick release system by breaking the flexible links 188 and allow the topsides to vertically uncouple from the grillage system 125 on the barges.

Advantageously, the flexible links 188 could be coupled to each other at a given attachment point, such in a loop or linearly, between the topsides and the grillage system. If either flexible link 188 breaks at the attachment point, then the quick release system 180 would be released and the topsides 110 could be vertically uncoupled from the grillage system 125. This redundancy could assist in providing a more predictable release of the topsides for synchronization with other quick release systems 180 on other attachment points 135 between the topsides and grillage system.

Figure 9C:
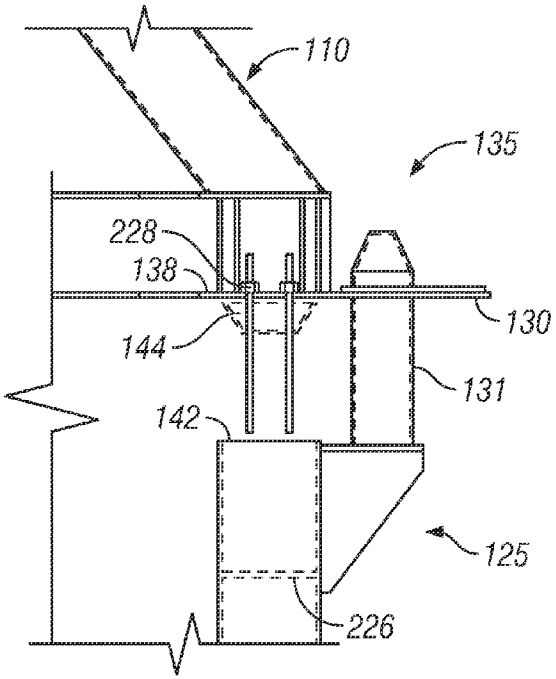
FIG. 9C is a schematic end view of the embodiment of FIG. 9A with the quick release system in a released position.
Figure 9D:
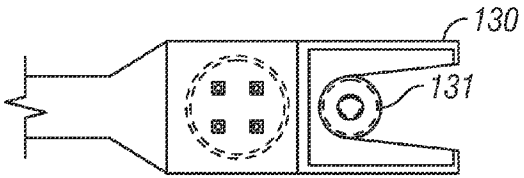
FIG. 9D is a schematic top view of the embodiment of FIG. 9C in the released position.
Figure 9A:
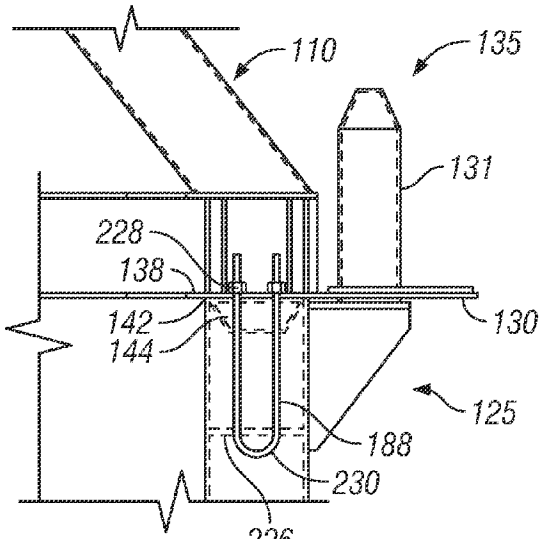
FIG. 9A is a schematic end view of another embodiment of the quick release system in a closed position.
Figure 9B:
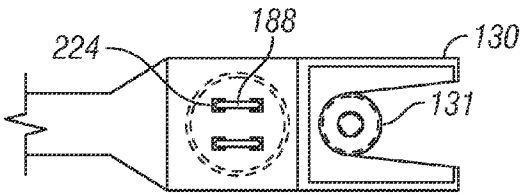
FIG. 9B is a schematic top view of the embodiment of FIG. 9A in the closed position.

FIG. 9A is a schematic end view of another embodiment of the quick release system in a closed position. FIG. 9B is a schematic top view of the embodiment of FIG. 9A in the closed position. FIG. 9C is a schematic end view of the embodiment of FIG. 9A with the quick release system in an open position. FIG. 9D is a schematic top view of the embodiment of FIG. 9C in the open position. The figures will be described in conjunction with each other. The embodiment is similar to the embodiment described in conjunction with FIGS. 8A-8D, but also includes a further quick release system of frangible elements, generally including frangible nuts, explosive bolts and nuts (also known as pyrotechnic fasteners), and other frangible fasteners that can be actuated to fail upon certain occurrences and in addition to the tensile loads on the flexible elements described above. For example, a pyrotechnic fastener is generally a fastener, usually a nut or bolt, that incorporates a pyrotechnic charge as an actuator that can be initiated remotely. One or more explosive charges embedded within the fastener can be typically actuated by an electric current, and the charge can break the fastener into two or more pieces. The fasteners are typically formed with weakened portions around their circumference at the point(s) where the severance should occur. In other embodiments, the frangible element can be shaped to fail at a given load and thus the load would function as the actuator. Frangible elements are commercially available, their activation is known, and it is believed to be unnecessary to describe in further detail.

The grillage system 125 can include a grillage seat 142, and the topsides 110 can include a seating guide 144 to engage the grillage seat and limit the downward travel of the topsides relative to the grillage system. The grillage seat 142 can also have a lateral anchor plate 226 positioned below the seating guide 144 when engaged with the grillage seat. The quick release system 180 can include at least one flexible link and advantageously a plurality of flexible links 188 coupled between the topsides 110 and the grillage system 125. For example, the flexible links can be coupled between a support structure 138 on the topsides 110 and the anchor plate 226 on the grillage system with one or more anchors 228 coupled to the flexible links through openings 224 formed therethrough for the flexible links. The flexible links can be designed to fail at a given rated tensile load.

The flexible links 188 could be coupled to each other, such in a loop or linearly, between the topsides and the grillage system. If either flexible link 188 breaks, then the quick release system 180 would be released and the topsides 110 could be vertically uncoupled from the grillage system 125. This redundancy could assist in providing more predicable release of the topsides for synchronization with other quick release systems 180 on other attachment points 135 between the topsides and grillage system.

The embodiment can also include frangible elements 230 that can be coupled to the flexible links as another quick release system in addition to the flexible links. The frangible elements 230 can be actuated to fail, such as explode, at a certain time, pressure, load, or signal to release the flexible links. In at least one embodiment, the frangible elements can be used in addition to the flexible links to assist in assuring the actuation of the quick release system or systems and release of the topsides from the grillage system.

In operation, the topsides could be transferred to the offshore structure, so that the tensile force on the flexible links would increase as the offshore structure progressively supports more of the topsides load and displaces the load away from the barges. The increased force eventually would actuate the quick release system by breaking the flexible links 188 and allow the topsides to vertically uncouple from the grillage system 125 on the barges. The frangible elements could be actuated when the flexible links are designed to fail to assist in assuring that one or more of the quick release systems function at the intended occurrence. Alternatively, the flexible links could be designed to fail (and therefore actuated) after the frangible elements are actuated, so that the flexible links provide a secondary backup system to the frangible elements. Further, the frangible elements could be actuated after the flexible links are designed to fail, so that the frangible elements provide a secondary backup system to the flexible links.

Thus, at least some embodiments can have multiple quick release systems at a given attachment point, such as those described above, various combinations of quick release systems described herein, and others. Such multiple quick release systems can assist in assuring the timely release of at least one quick release system and the synchronization of quick release systems at multiple attachment points.

In another embodiment by a variation of the embodiments in FIGS. 8A-8D and FIGS. 9A-9D, the frangible element could be used in lieu of the flexible link and coupled directly between the topsides and grillage system. so that actuation of the frangible element would directly release the quick release system and therefore the topsides from the grillage system. Given the descriptions provided herein, it is believed that no further description of this embodiment is required.

Other and further embodiments utilizing one or more aspects of the inventions described above can be devised without departing from the spirit of Applicant's invention. Further, the various methods and embodiments of the catamaran system can be included in combination with each other to produce variations of the disclosed methods and embodiments. Still further, the concepts of the quick release system explained here within the exemplary context of a catamaran system can be used with a single barge supporting a topsides thereon, and therefore the invention is not limited to the embodiments herein or the catamaran exemplary application of the quick release system herein. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of loading a topsides onto an offshore platform, comprising:

positioning a topsides having a weight in proximity to one or more barges having a grillage system and the grillage system having at least one attachment point for the topsides;

transferring at least a portion of the weight of the topsides to the one or more barges and vertically supporting the weight of the topsides with the grillage system;

laterally coupling the topsides to the at least one attachment point on the grillage system on the one or more barges;

vertically restraining the topsides to the grillage system with at least one quick release system by applying a tension force to the topsides independently of the vertical supporting of the weight of the topsides with the grillage system;

transporting the topsides and the one or more barges to the offshore platform;

adjusting a relative elevation between the topsides and the offshore platform;

transferring at least a portion of the weight of the topsides to the offshore platform;

laterally uncoupling the topsides from the at least one attachment point on the grillage system on each barge; and vertically uncoupling the topsides from the grillage system by actuating the at least one quick release system.

2. The method of claim 1, wherein the at least one quick release system comprises a hook having a rotatable portion hingeably coupled to a remainder of the hook, the rotatable portion being releasable by a latch, and further comprising:

coupling a first portion of the at least one quick release system to the rotatable portion of the hook, and a second portion of the at least one quick release system to the remainder of the hook, one portion being coupled to the topsides and the other portion being coupled to the grillage system, and wherein vertically uncoupling the topsides from the grillage system by actuating the at least one quick release system comprises releasing the latch to allow the rotatable portion to release at least one of the portions of the at least one quick release system.

3. The method of claim 2, wherein the latch is coupled to a winch and further comprising actuating the winch to release the latch.

4. The method of claim 3, wherein a plurality of quick release systems are coupled to the winch and wherein actuating the winch release the latches on the plurality of quick release systems that are coupled to the winch.

5. The method of claim 1, further comprising:

operatively coupling a plurality of quick release systems at a plurality of attachment points, wherein vertically uncoupling the topsides from the grillage system comprises synchronizing the vertical uncoupling of the topsides with the plurality of quick release systems.

6. The method of claim 5, further comprising simultaneously releasing the topsides from the grillage systems at the plurality of attachment points.

7. The method of claim 1, wherein the at least one quick release system comprises a releasable element and at least two portions of the at least one quick release system coupled between the topsides and the grillage system and separated by the releasable element, further comprising:

coupling one of the portions of the at least one quick release system to the topsides and the releasable element;

coupling the other of the portions of the at least one quick release system to the grillage system and the releasable element, and wherein vertically uncoupling the topsides from the grillage system by actuating the at least one quick release system comprises actuating the releasable element to release at least one of the portions of the at least one quick release system.

8. The method of claim 1, further comprising moving the one or more barges away from the offshore platform with the topsides positioned on the offshore platform.

9. The method of claim 1, further comprising:

coupling at least one bracing member between the topsides and each grillage system on each barge inwardly from a lateral center of gravity of each of the one or more barges before transporting the topsides and the one or more barges to the offshore platform; and uncoupling the at least one bracing member between the topsides and each grillage system after transferring at least the portion of the weight of the topsides to the offshore platform.

10. The method of claim 1, wherein laterally coupling the topsides to the at least one attachment point on the grillage system on each barge comprises coupling a locking plate at least partially around a guide pin on at least one of the attachment points on each of the grillage systems.

11. The method of claim 10, wherein vertically uncoupling the topsides from the grillage system by actuating the at least one quick release system comprises increasing a tensile force on at least one flexible link having a rated tensile load failure strength until the at least one flexible link breaks to release the topsides from the grillage system.

12. The method of claim 11, wherein vertically uncoupling the topsides from the grillage system by actuating the at least one quick release system comprises actuating a frangible element to release the topsides from the grillage system.

13. The method of claim 1, wherein vertically uncoupling the topsides from the grillage system by actuating the at least one quick release system comprises actuating a frangible element to release the topsides from the grillage system.

14. A system for loading a topsides onto an offshore platform, comprising:

a topsides having a weight supported on one or more barges having a grillage system and each grillage system having at least one attachment point for the topsides, the grillage system configured to vertically support the weight of the topsides;

at least one quick release system configured to be coupled to the topsides;

a means for laterally coupling the topsides to the at least one attachment point on the grillage system on each barge;

a means for vertically restraining the topsides to the grillage system with the at least one quick release system independently of the grillage system vertical support for the weight of the topsides;

a means for laterally uncoupling the topsides from the at least one attachment point on the grillage system on each barge; and a means for vertically uncoupling the topsides from the grillage system by actuating the at least one quick release system.

15. The system of claim 14, wherein the at least one quick release system comprises a hook having a rotatable portion hingeably coupled to a remainder of the hook, the rotatable portion being releasable by a latch hingeably coupled to the hook.

16. The system of claim 15, further comprising a winch coupled to the latch.

17. The system of claim 16, wherein a plurality of quick release systems are coupled to the winch and further comprising a control system configured to control the winch.

18. The system of claim 14, further comprising:

a plurality of quick release systems coupled between the topsides and the grillage system at a plurality of attachment points; and a control system configured to synchronize an uncoupling of the topsides with the plurality of quick release systems.

19. The system of claim 14, wherein:

a portion of the at least one quick release system is coupled between one of the topsides or the grillage system to a releasable element;

another portion of the at least one quick release system is coupled to the other of the topsides or the grillage system; and the releasable element is configured to be actuated to release at least one of the portions to release the topsides from the grillage system.

20. The system of claim 14, wherein the at least one quick release system comprises at least one flexible link with a rated tensile load failure strength and wherein the means for vertically uncoupling the topsides from the grillage system comprises increasing a tensile force on the flexible link until the flexible link breaks.

21. The system of claim 20, wherein the at least one quick release system comprises a frangible element and wherein the means for vertically uncoupling the topsides from the grillage system comprises actuating the frangible element to break.

22. The system of claim 14, wherein the at least one quick release system comprises a frangible element and wherein the means for vertically uncoupling the topsides from the grillage system comprises actuating the frangible element to break.

* * * * *